US010011137B2

(12) United States Patent
Ray

(10) Patent No.: US 10,011,137 B2
(45) Date of Patent: Jul. 3, 2018

(54) DRY LITHOGRAPHIC IMAGING AND PRINTING WITH PRINTING MEMBERS HAVING ALUMINUM SUBSTRATES

(71) Applicant: Kevin Ray, Windham, NH (US)

(72) Inventor: Kevin Ray, Windham, NH (US)

(73) Assignee: PRESSTEK, LLC, Hudson, NH (US)

( * ) Notice: Subject to any disclaimer, the term of this patent is extended or adjusted under 35 U.S.C. 154(b) by 0 days.

(21) Appl. No.: 15/613,896

(22) Filed: Jun. 5, 2017

(65) Prior Publication Data

US 2017/0267011 A1 Sep. 21, 2017

Related U.S. Application Data

(63) Continuation of application No. 14/944,714, filed on Nov. 18, 2015.

(51) Int. Cl.

| | |
|---|---|
| ***B41N 1/12*** | (2006.01) |
| ***B41C 1/10*** | (2006.01) |
| ***B41F 7/20*** | (2006.01) |
| *B41N 1/00* | (2006.01) |

(52) U.S. Cl.

CPC ..... *B41N 1/12* (2013.01); *B41C 1/1033* (2013.01); *B41F 7/20* (2013.01); *B41C 2210/04* (2013.01); *B41C 2210/16* (2016.11); *B41N 1/003* (2013.01)

(58) Field of Classification Search

CPC ..... B41N 1/12; B41N 1/003; B41C 1/1033; B41C 2210/16; B41C 2210/04; B41F 7/20

See application file for complete search history.

(56) References Cited

U.S. PATENT DOCUMENTS

| | | | | |
|---|---|---|---|---|
| 5,148,746 | A * | 9/1992 | Fuller | B41C 1/1033 101/142 |
| 5,339,737 | A | 8/1994 | Lewis et al. | |
| 5,493,971 | A | 2/1996 | Lewis et al. | |
| 5,780,200 | A * | 7/1998 | Kitaguchi | B41C 1/05 430/270.1 |
| 6,096,476 | A | 8/2000 | Yanagida et al. | |
| 6,284,433 | B1 | 9/2001 | Ichikawa et al. | |
| 8,026,041 | B2 | 9/2011 | Melamed et al. | |
| 8,283,107 | B2 | 10/2012 | Melamed et al. | |
| 9,164,378 | B2 | 10/2015 | Iihara et al. | |
| 2002/0094490 | A1 | 7/2002 | Endo et al. | |
| 2005/0123853 | A1 | 6/2005 | Munnelly et al. | |

(Continued)

FOREIGN PATENT DOCUMENTS

| | | |
|---|---|---|
| JP | 09131977 | 5/1997 |
| JP | 09131979 | 5/1997 |

(Continued)

OTHER PUBLICATIONS

European Search Report, European Application No. EP 16191396.7, dated Apr. 18, 2017, 8 pages.

*Primary Examiner* — Alison L Hindenlang
*Assistant Examiner* — Michael Robinson
(74) *Attorney, Agent, or Firm* — Morgan, Lewis & Bockius LLP

(57) ABSTRACT

Negative-working, IR-sensitive dry printing plates utilize an oleophobic topmost layer, a nitrocellulose-based imaging layer ablatable by laser discharge, and a grained metal substrate with no heat-insulating layer intervening between the imaging layer and the substrate.

7 Claims, 1 Drawing Sheet

(56) References Cited

U.S. PATENT DOCUMENTS

| | | | | |
|---|---|---|---|---|
| 2008/0166658 | A1* | 7/2008 | Kim | B41N 1/12 430/271.1 |
| 2012/0055363 | A1 | 3/2012 | Danzinger et al. | |
| 2012/0156624 | A1* | 6/2012 | Rondon | B41C 1/1016 430/320 |

FOREIGN PATENT DOCUMENTS

| | | |
|---|---|---|
| WO | 9706956 | 2/1997 |
| WO | 9831550 | 7/1998 |
| WO | 2004011259 | 2/2004 |

* cited by examiner

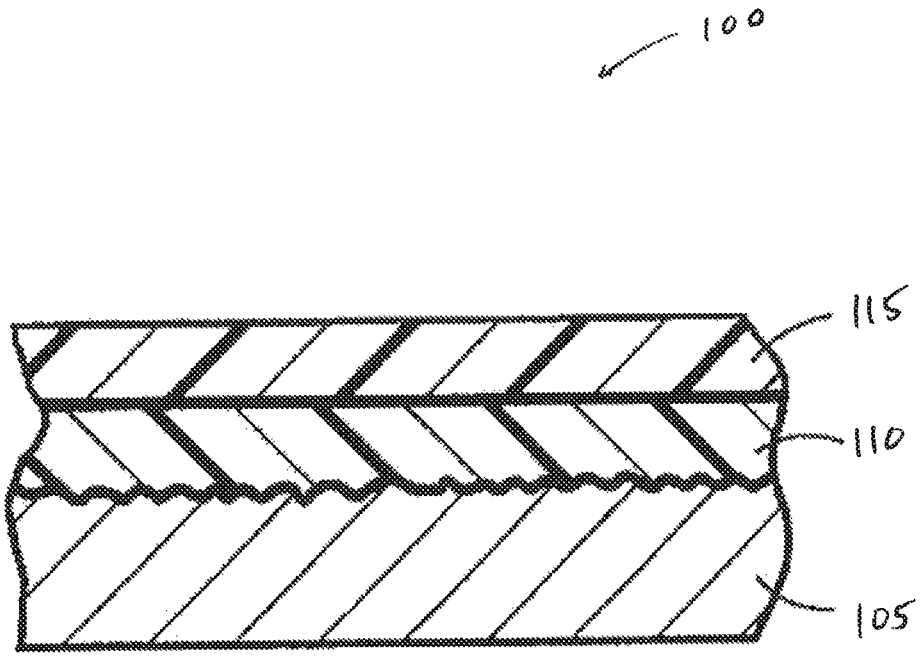
100
115
110
105

DRY LITHOGRAPHIC IMAGING AND PRINTING WITH PRINTING MEMBERS HAVING ALUMINUM SUBSTRATES

RELATED APPLICATIONS

This application is a continuation of U.S. Ser. No. 14/944,714, filed Nov. 18, 2015, the entire disclosure of which is hereby incorporated by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the wetted printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Three-layer plates, for example, are made ready for press use by image-wise exposure to imaging (e.g., infrared or "IR") radiation that causes ablation of all or part of the central layer, destroying the bonding to the overlying (typically polymer) layer in the exposed areas. One well-established three-layer dry plate design utilizes an oleophilic substrate, a polymeric (e.g., nitrocellulose) central "imaging" layer, and an inherently oleophobic (e.g., silicone or a fluoropolymer) top layer. Retaining heat generated within the imaging layer is essential to successful imaging of the plate at commercially realistic laser fluence levels. This is easily achieved in the case of polymeric base supports, since polymeric materials typically conduct heat poorly (and, hence, thermal losses into and through this layer are minimal). By contrast, thermally conductive supports, such as aluminum or other metals, pose design challenges. Such supports are commonly employed in plates used on large web presses, such as those used by publishers of newspapers, that do not provide clamping mechanisms to retain printing plates against the plate cylinders. Instead, the leading and trailing edges of the plate are each crimped and inserted into a slot on the corresponding cylinder, so the plate is held against the surface of the cylinder by the mechanical flexion of the bent edges. A second environment favoring use of metal substrates involves large-sized plates. The dimensional stability of plastic- or film-based plates tends to decrease with size unless the thickness of the substrate is increased; however, depending on the size of the plate, the amount of thickening necessary to retain acceptable rigidity can render the plate unwieldy, uneconomical or both. By contrast, metal substrates can provide high degrees of structural integrity at relatively modest thicknesses, so dry plates must typically be manufactured on a different coating line.

One well-known expedient for limiting heat dissipation into a metal base support is to add a heat-insulating polymeric layer between the base support and the imaging layer; see, e.g., U.S. Pat. Nos. 6,096,476 and 6,964,841. In such plates, the heat-insulating layer may persist after cleaning and serve as the ink acceptor. This approach complicates plate manufacture and increases cost not only in adding an extra layer to the plate construction, but in limiting the coating lines that may be used. Wet plates, for example, may be manufactured on coating lines set up to apply two successive polymer layers onto an aluminum substrate. Such lines are unsuitable for plates requiring application of an additional layer.

SUMMARY OF THE INVENTION

It has been found, surprisingly, that when heat-sensitive layers comprising an IR absorber and a crosslinked nitrocellulose composition are utilized in conjunction with roughened, anodized aluminum sheets, heat-insulating layers are superfluous and can be omitted from the plate without any deterioration in the waterless printing performance. This results in a simplified structure that, with different materials, typifies many conventional wet-plate designs. As a result, plates in accordance herewith may be manufactured on coating lines designed for wet plates. Although metals such as aluminum are often used in wet plates to adsorb fountain solution and thereupon reject ink, they may also be oleophilic and can therefore be used in dry plates as base supports that participate in the printing process. In wet plates, metal layers are often roughened to enhance hydrophilicity. When used in dry plates, by contrast, such layers are typically not roughened as their surface properties are not relevant to printing; that is, the unmodified surface of the metal support is typically coated with a heat-insulating polymer that is retained after imaging and provides an oleophilic surface for ink retention during printing.

Accordingly, in a first aspect, the invention pertains to a method of manufacturing a dry lithographic printing member. In various embodiments, the method comprises the steps of providing a metal (e.g., aluminum) sheet having a grained surface; applying, directly to the metal sheet, a polymeric imaging layer consisting essentially of a nitrocellulose composition having dispersed therein an infrared-absorbing dye or pigment and a crosslinkable binder; crosslinking the polymeric imaging layer; applying, over the imaging layer, an oleophobic composition consisting essentially of a silicone or a fluoropolymer; and crosslinking the oleophobic composition. The grained surface may be created by one or more of anodizing, electrograining, or roughening with a fine abrasive—e.g., electrograining followed by anodizing.

The nitrocellulose composition may have a nitration level above 10.7% but less then 12.3%. In various embodiments, the nitrocellulose composition has a viscosity ranging from 1/16 second to 3 seconds, 1/8 second to 1 second, or 1/8 second to 1/2 second. The metal sheet may have an Ra roughness of at least 0.20.

In another aspect, the invention pertains to a lithographic printing member. In various embodiments, the lithographic printing member comprises, consists essentially of or consists of an oleophobic topmost layer; disposed thereunder, a crosslinked polymeric imaging layer consisting essentially of a nitrocellulose composition having dispersed therein an infrared-absorbing dye or pigment; and disposed under and in direct contact with the polymeric imaging layer, a metal (e.g., aluminum) sheet having a grained surface. In particular, there is no insulating or other layer intervening between the metal sheet and the imaging layer.

The nitrocellulose composition may have a nitration level above 10.7% but less then 12.3%. In various embodiments, the nitrocellulose composition has a viscosity ranging from 1/16 second to 3 seconds, 1/8 second to 1 second, or 1/8 second to 1/2 second. The metal sheet may have an Ra roughness of at least 0.20. The nitrocellulose composition may include a binder resin, e.g., a melamine resin.

Still another aspect of the invention relates to a method of dry printing. In various embodiments, the method comprises the steps of providing a lithographic printing member comprising, consisting essentially of or consisting of (i) an oleophobic topmost layer, (ii) disposed thereunder, a cross-linked polymeric imaging layer consisting essentially of a nitrocellulose composition having dispersed therein an infrared-absorbing dye or pigment, and (iii) disposed under and in direct contact with the polymeric imaging layer, a metal sheet having a grained surface; exposing the printing member to infrared imaging radiation in an imagewise pattern to cause ablation of the imaging layer; cleaning the printing member to reveal the grained metal surface; and printing with the printing member by repeatedly applying only ink to the printing member, whereby the ink adheres to the grained metal surface where revealed and not to the oleophobic layer, and transferring the ink to a recording medium. For example, the cleaning step may be performed using plain tap water (e.g., wet rubbing with a cotton towel saturated with plain tap water). As described in greater detail below, imaging followed by cleaning may not expose a pristine grained metal surface free of imaging debris, and in fact, this debris is generally oleophilic and therefore contributes to, rather than interfering with, lithographic performance. Accordingly, terminology referring to revealing the grained metal surface does not exclude the presence of imaging debris thereon, so long as lithographic performance is not impaired.

The nitrocellulose composition may have a nitration level above 10.7% but less then 12.3%. In various embodiments, the nitrocellulose composition has a viscosity ranging from 1/16 second to 3 seconds, 1/8 second to 1 second, or 1/8 second to 1/2 second. The metal sheet may have an Ra roughness of at least 0.20. The nitrocellulose composition may include a binder resin, e.g., a melamine resin.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement. The term "substantially" or "approximately" means±10% (e.g., by weight or by volume), and in some embodiments, ±5%. The term "consists essentially of" means excluding other materials that contribute to function or structure. For example, a radiation-sensitive composition consisting essentially of a nitrocellulose component, a polymerizable binder, and a radiation-absorbing component may include other ingredients, such as a catalyst, that may perform important functions but do not constitute part of the polymer structure of the composition following polymerization. Percentages refer to weight percentages unless otherwise indicated.

DESCRIPTION OF DRAWINGS

The foregoing discussion will be understood more readily from the following detailed description of the disclosed technology, when taken in conjunction with the single FIGURE of the drawing, which is an enlarged cross-sectional view of a negative-working printing member according to the invention.

DETAILED DESCRIPTION

1. Imaging Apparatus

The coated plate is imaged in an imaging device, typically by means of a modulated signal, e.g., a modulated near-IR laser. The laser is rastered over the plate surface while the laser intensity is modulated according to digital information so that only the background areas of the plate receive exposure. An imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 35,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The level of the exposure depends on the power of the laser, the size of the laser spot, and the composition of the coating, but is preferably chosen to deliver an area energy density or fluence between 100 and 250 mJ/cm$^2$, and more preferably between 100 and 150 mJ/cm$^2$. Examples of suitable exposure devices are the COMPASS 8030 and the DIMENSION PRO 800, both provided by Presstek Inc. Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion. The imaging device is typically integrated into a platemaker or a press.

2. Lithographic Printing Members

FIG. 1 illustrates a negative-working dry printing member 100 according to the invention that includes a metal substrate 105, a nitrocellulose-based imaging layer 110, and an oleophobic topmost layer 115. Layer 110 is sensitive to imaging (generally IR) radiation as discussed below, and imaging of the printing member 100 (by exposure to IR radiation) ablates layer 110. "Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

Most or all of the layers used in the present invention are continuous. The term "continuous" as used herein means that the underlying surface is completely covered with a uniform layer of the deposited material. Each of the layers and its functions are described in detail below.

2.1 Substrate 105

The substrate provides dimensionally stable mechanical support to the printing member. The substrate should be metal and have a roughened or structured surface. In general, any treatments usually applied to the surface of a "wet printing" plate so that the surface accepts fountain solution may be advantageously used, even though the plate is not used for wet printing. In particular, any of various chemical or electrical techniques, in some cases assisted by the use of fine abrasives to roughen the surface, may be employed. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341. A structured or grained surface can also be produced by controlled oxidation, a process commonly called "anodizing." An anodized aluminum substrate consists of an unmodified base layer and a porous, "anodic" aluminum oxide coating thereover; this coating readily accepts water. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. Anodizing and silicate treatment processes are described in U.S. Pat. Nos. 3,181,461 and 3,902,976. Post-anodic treatment—for example, with poly(vinyl phosphonic acid) or a monosodium phosphate solution, or a sodium silicate solution—is optional.

Preferred substrate materials include aluminum that has been mechanically, chemically, and/or electrically grained with subsequent anodization. The thickness of substrate 105 generally ranges from 0.004 to 0.02 inch, with thicknesses in the range 0.005 to 0.012 inch being typical.

The surface roughness Ra of the surface, after it has been subjected to a surface-roughening treatment and an anodizing treatment, may be from 0.2 to 1.0 μm, and more typically from 0.4 to 0.7 μm. The surface roughness Ra is a value represented by the following formula:

$$Ra=[\int_0^L |f(x)|dx]L$$

wherein a reference length L is extracted in the direction of an average line from a roughness curve of the surface at which the surface roughness is measured, and the direction of this average line of the extracted portion is along the x axis, and the direction of the vertical magnification is along the y axis, and the roughness curve is expressed as y=f(x). The unit of the surface roughness Ra is usually μm. The reference length L is usually 3 mm, but is not limited to this length.

The maximum roughness $R_{max}$ is the maximum value of the distance between a protrusion peak line and a indentation bottom line in a portion of an evaluation length d. The evaluation length is usually 3 mm, but in the same way as the surface roughness Ra, is not limited to this length. The maximum roughness $R_{max}$ in the surface of substrate 105 may be 10 μm or less, e.g., from 7 to 2 μm.

2.2 Imaging Layer 110

The primary characteristics of layer 110 are vulnerability to ablation using commercially practicable laser imaging equipment and sufficient durability to withstand the rigors of printing. The latter characteristic depends, in part, on application weight. Layer 110 should also, upon ablation, produce environmentally and toxicologically innocuous byproducts. Vulnerability to ablation ordinarily stems from the ability to absorb strongly in the wavelength region in which the imaging laser emits. Absorption can be enhanced by use of a polymeric system that intrinsically absorbs in the wavelength region of interest, or more typically by use of radiation-absorptive components that have been dispersed or dissolved in the coating.

In general, layer 110 is a nitrocellulose-based composition including or consisting essentially of a nitrocellulose polymer, a crosslinkable binder, and an IR absorber. Without crosslinking, the layer 110 may exhibit insufficient solvent resistance. A typical composition includes or consists essentially of a nitrocellulose polymer, a crosslinkable binder (and, in some cases, a crosslinker that reacts with the binder molecule to form crosslinking covalent bonds), and a catalyst. Additional materials, which are useful but do not contribute to function, may include a surfactant and/or a colorant. Typical percentages by weight are: binder, 35% to 60%; nitrocellulose, 15% to 40%; IR absorber (e.g., a dye), 17% to 40%; and other materials (surfactant, catalyst, colorant), ~5%.

Preferably, the nitrocellulose has a moderate viscosity in solution, and furthermore, since it has hydroxyl groups in the molecule, it is likely to undergo some degree of crosslinking Nitrocellulose having any of various molecular weights may be used to advantage. It is preferable that the nitrocellulose is not an explosive grade (>12.5% nitration), but is preferably that for industrial use (>10.7 nitration, but <12.3% nitration).

The viscosity of nitrocellulose can be measured according to the method specified in ASTM D 301-72. It is preferred that the nitrocellulose used in layer 110 is 1/16 seconds to 3 seconds, preferably 1/8 second to 1 second, more preferably 1/8 second to 1/2 second in the specified viscosity. If the viscosity is less than 1/16 second, the printing durability of the plate 100 is likely to decline, since the nitrocellulose is too low in polymerization degree. If the viscosity is more than 1 second, it is so high as to inconvenience handling, and the coatability in producing the printing plate 100 declines unfavorably. Nitrocellulose is a straight-chain high polymer, and has a structure in which D-glucose as a component of it has three hydroxyl groups at the most. The nitrogen content is specified by the substitution degree of the hydroxyl groups by nitro groups. The nitrogen content refers to a rate of the atomic weight of nitrogen to the molecular weight of nitrocellulose and indicates the degree of nitration. A higher nitrogen content means a higher nitration degree. The nitrogen content can be obtained by, for example, elemental analysis.

If all the three hydroxyl groups of D-glucose are substituted by nitro groups, the nitrogen content is 14.1%, and if only one is substituted by a nitro group, the nitrogen content is 6.8%. That is, when the nitrogen content is larger, the number of hydroxyl groups in the molecule is smaller, and it tends to be difficult to form a crosslinked structure in the imaging layer 110. Therefore, the nitrocellulose used in the present invention is preferably 12.5% or less, more preferably 6.8% to 12.5%. If the nitrogen content is smaller than 6.8%, the sensitivity of the printing plate 100 declines, and the solubility in the solvent is also likely to decline. If the nitrogen content is larger than 12.5%, the number of hydroxyl groups is so small as to make it difficult to form a crosslinked structure in the heat sensitive layer, and as a result, printing durability declines unfavorably.

The binder resin is desirably a melamine resin. Suitable melamine resins include methylated, low-methylol, high-imino melamine materials. For example CYMEL crosslinkers from Cytek Industries, Inc., especially CYMEL 385, CYMEL 303, CYMEL 328, CYMEL 327, CYMEL 325 and CYMEL 323, may be employed. Melamine crosslinking may be facilitated by a sulfonic acid catalyst, typically a p-toluenesulfonic acid catalyst. When a melamine resin is used as the optional binder, the heat sensitive layer is a crosslinked layer.

The IR absorber is preferably an IR absorbing dye. The imaging layer 110 has a dry coat weight of 0.5 to 2.5 g/m$^2$, preferably 1 to 2 g/m$^2$. Also, imaging layer 110 is cured and dried at 220 to 320° F., and especially 240 to 280° F. (i.e., approximately 104 to 160° C., especially 115 to 137° C.).

2.3 Oleophobic Layer 115

The topmost layer 115 participates in printing and provides the requisite lithographic affinity difference with respect to substrate 105; in particular, layer 115 is oleophobic and suitable for dry printing. In addition, topmost layer 115 may help to control the imaging process by modifying the heat-dissipation characteristics of the printing member at the air-imaging layer interface.

Typically, layer 115 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer. Silicone polymers are typically prepared by crosslinking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

The silicone layer may have a dry coating weight of, for example, 0.5 to 2.5 g/m$^2$, with the range 1 to 2.5 g/m$^2$ being particularly preferred for typical commercial applications.

3. Imaging and Printing

When the printing member 100 is exposed imagewise to IR radiation, imaging layer 110 absorbs the imaging pulses and converts them to heat. The heat diffuses through layer 110 and builds up until the layer 110 ablates, i.e., undergoes either rapid phase transformation (e.g., vaporization) or catastrophic thermal overload. After imaging, topmost layer 115 is degraded and/or de-anchored in the areas that received imaging radiation, and may be removed mechanical action, e.g., rubbing with a cleaning liquid (which may be plain tap water). Post-imaging cleaning may or may not remove all ablation debris from the surface of layer 105, i.e., remnants of layer 110 may remain adhered to substrate 105. An advantage of plate construction 100 is that these remnants will be oleophilic and therefore accept ink, as do exposed portions of substrate 105 where no ablation debris exists. Therefore, it is unnecessary to expend effort in removing ablation debris, simplifying the cleaning process.

Printing with the printing member includes applying ink to the printing member and transferring the applied ink, which will adhere only to regions where topmost layer 115 has been removed, to a recording medium such as paper. The inking and transferring steps may be repeated a desired number of times, e.g., at least 100,000 impressions, and often 150,000 or more. Using a thicker silicone layer (e.g., 2.5 g/m$^2$) lengthens the print run.

EXAMPLES

Example 1

This example involves a negative-working waterless printing plate that includes an oleophobic silicone layer, disposed on an imaging layer comprising an IR-absorbing dye and nitrocellulose disposed on a roughened, anodized aluminum substrate.

The IR-absorbing imaging layer contains the following components:

| Components | Parts by Weight Example 1 |
|---|---|
| Cymel 303 | 50.16 |
| Victoria Blue BO Dye | 0.69 |
| Lubrizol 2062 | 0.50 |
| S0094 NIR Dye | 28.09 |
| Cycat 4040 | 4.20 |
| BYK 307 | 1.31 |
| Walsroder E400 NC | 15.05 |

CYMEL 303 is a methylated melamine resin supplied by Cytek industries, Inc. (West Paterson, N.J.). CYCAT 4040 is a general purpose, p-toluenesulfonic acid catalyst supplied as a 40% solution in isopropanol by Cytek Industries, Inc. BYK 307 is a polyether modified polydimethylsiloxane surfactant supplied by BYK Chemie (Wallingford, Conn.). S0094 is a cyanine near IR dye manufactured by FEW Chemicals GmbH (Bitterfeld-Wolfen, Germany), which has a reported coefficient of absorption of $2.4\times10^5$ L/mol-cm at the maximum absorption wavelength, $\lambda_{max}$, of about 813 nm (measured in methyl ethyl ketone (MEK) solution). Victoria Blue BO Dye was supplied by Keystone Aniline Corporation, Chicago, Ill. Lubrizol 2062 is a phosphate ester material as supplied by Lubrizol Corporation, Wickliffe, Ohio. Walsroder E400 NC is nitrocellulose nitrated to 11.8-12.3% as supplied by Dow Wolff Cellulosics, Walsrode, Germany.

Example 1 was prepared as a solution in 1-methoxypropan-2-ol/N-methyl-2-pyrrolidone (81:19 v:v). The substrate used was a 0.3 mm-thick sheet of aluminum that had been electrochemically grained and sulfuric acid anodized (oxide weight of 2.7 g/m$^2$), then post-treated with a monosodium phosphate solution containing sodium fluoride. The coating solution was coated onto the substrate by means of a wire-wound bar. The solution concentration was selected to provide the specified dry film composition with a coating weight of 1.8 g/m$^2$ after thorough drying and curing at 130° C. (measured on the web). Drying and curing were carried out on a belt conveyor oven, SPC Mini EV 48/121, manufactured by Wisconsin Oven Corporation (East Troy, Wis.). The conveyor was operated at a speed of 3.2 feet/minute, which gives a dwell time of about 40 seconds in the air-heated zone of the oven. The actual temperatures on the aluminum were measured with calibrated temperature strips. In this oven, the temperature dial was set to 135° C. to bring the polymer web to the preferred curing temperature of 130° C.

The oleophobic silicone top layer of the plate members was subsequently disposed on the dried and cured imaging layer using the formulation given below. The silicone layer exhibits a highly crosslinked network structure produced by the addition or hydrosilylation reaction between the vinyl groups (SiVi) of vinyl-terminated functional silicones and the silyl (SiH) groups of trimethylsiloxy-terminated poly (hydrogen methyl siloxane) crosslinker, in the presence of a Pt catalyst complex and an inhibitor.

| Component | Parts |
|---|---|
| PLY-3 7500P | 12.40 |
| DC Syl Off 7367 Crosslinker | 0.53 |
| CPC 072 Pt Catalyst | 0.17 |
| Heptane | 86.9 |

The PLY-3 7500P is an end-terminated vinyl functional silicone resin, with average molecular weight 62,700 g/mol, supplied by Nusil Silicone Technologies (Charlotte, N.C.). The DC SYL OFF 7367 is a trimethylsiloxy-terminated poly(hydrogen methylsiloxane) crosslinker manufactured by Dow Corning Silicones (Midland, Mich.) which is supplied as a 100% solids solution containing about 30% 1-ethynylcyclohexane [CH═CH—CH($CH_2$)$_5$], which functions as catalyst inhibitor. The CPC 072 is a 1,3 diethyenyl-1,1,3,3-tetramethyldisiloxane Pt complex catalyst, manufactured by Umicore Precious Metals (South Plainfield, N.J.), which is supplied as a 3% xylene solution. The formulation solvent, heptane, is supplied by Houghton Chemicals (Allston, Mass.). The silicone formulation was applied to the polymer imaging layers with a wire-round rod, then dried and cured at 150° C. (measured on the web) to produce uniform silicone coatings of 2.5 g/m$^2$ using the same oven and conditions above.

The printing members were evaluated as follows to assess solvent resistance, environmental stability, and imaging sensitivity:

1. Imaging layer-only plate samples stored at ambient conditions are tested by assessing solvent resistance with MEK. An MEK resistance test is conducted on pieces (~20 cm length) of the plate samples by applying, in a reciprocating mode at a five-pound load, double-rubs with a cotton towel saturated with MEK. The cycle is repeated to the point of visual evidence failure: marring of the surface or loss of silicone adhesion. To pass this test, the plates should resist more than 5 cycles of the test without showing signs of failure.
2. Plate precursors are imaged on a KODAK TRENDSETTER image-setter (operating at a wavelength of 830 nm, available from Eastman Kodak Company). Sensitivity information is obtained from the evaluation of different imaging patterns (solid screen, 3×3, and 2×2 patterns) run at increasing laser power levels (watts) at a constant drum speed of 160 rpm (7 W, 124 mJ/cm$^2$; 8 W, 141 mJ/cm$^2$; 9 W, 159 mJ/cm$^2$; 10 W, 177 mJ/cm$^2$; 11 W, 195 mJ/cm$^2$; 12 W, 212 mJ/cm$^2$; 13 W, 230 mJ/cm$^2$; 14 W, 248 mJ/cm$^2$; 15 W, 265 mJ/cm$^2$; 16 W, 283 mJ/cm$^2$; 17 W, 301 mJ/cm$^2$). The imaged plates are manually cleaned to remove the loosened silicone debris left on the plate after imaging. Cleaning comprises a two-step procedure: first, dry rubbing the surface with a cotton towel, and second, wet rubbing with a cotton towel saturated with isopropanol.

The degree of plate sensitivity is ascertained from print sheets obtained by running the cleaned plates on a GTO Heidelberg press using black ink (Aqualess Ultra Black MZ waterless ink, Toyo Ink America LLC, Addison, Ill.) and uncoated stock (Williamsburg Plus Offset Smooth, 60 lb white, item no. 05327, International Paper, Memphis, Tenn.). The samples are run for at least 200 impressions. For purposes hereof, a high-speed plate embodiment is defined as one that produces print sheets showing well-defined high resolution patterns (2×2 and 3×3) at power levels below or equal to 150 mJ/cm$^2$. Plates requiring power levels higher than 150 mJ/cm$^2$ to produce prints with high-resolution patterns are classified as not passing this test.

Example 2

Example 1 was repeated, but the imaging layer was coated on a 0.3 mm-thick aluminum sheet that had been that had been electrochemically grained and sulfuric acid anodized (oxide weight of 2.7 g/m$^2$).

Example 3

Example 1 was repeated but the imaging layer was coated on a 0.3 mm-thick aluminum sheet that had been electrochemically grained and sulfuric acid anodized (oxide weight of 2.7 g/m$^2$), then post-treated with a 2% sodium silicate solution (the $SiO_2$ to $Na_2O$ ratio was 2:1, the support was immersed in a bath having a temperature of 82° C. for 45 seconds).

Comparative Example 4

Example 1 was repeated, but the imaging layer was coated on a 0.3 mm-thick degreased aluminum sheet without electrochemical graining, or anodizing, or post-anodic treatment.

Prophetic Example 5

Example 4 from U.S. Pat. No. 6,096,476 (the "'476 patent") is repeated, but the insulating layer is omitted and instead, the heat sensitive layer is directly applied to the degreased aluminum sheet as directed. The imaging sensitivity of the construction is inferior to that presented in Example 4 of the '476 patent (>460 mJ/cm$^2$).

Prophetic Example 6

Example 9 from the '476 patent is repeated, but the insulating layer is omitted and instead, the heat sensitive layer is directly applied to the degreased aluminum sheet as directed. The imaging sensitivity of the construction is inferior to that presented in Example 9 of U.S. Pat. No. 6,096,476 (>315 mJ/cm$^2$).

Comparative Example 7

This example involves a negative-working waterless printing plate that includes an oleophobic silicone layer, disposed on an imaging layer comprising an IR-absorbing dye and no nitrocellulose, which is itself disposed on a roughened, anodized aluminum substrate.

The IR-absorbing imaging layer contains the following components:

| Components | Parts by Weight Example 1 |
|---|---|
| Cymel 385 | 68.32 |
| Victoria Blue BO Dye | 2.44 |
| S0094 NIR Dye | 25.00 |
| Cycat 4040 | 3.00 |
| BYK 307 | 1.24 |

CYMEL 385 is a methylated melamine resin supplied by Cytek industries, Inc. (West Paterson, N.J.).

Comparative Example 7 was prepared as a solution in 1-methoxypropan-2-ol. The substrate used was a 0.3 mm-thick aluminum sheet that had been electrochemically grained and sulfuric acid anodized (oxide weight of 2.7 g/m$^2$), then post-treated with a 2% sodium silicate solution (the $SiO_2$ to $Na_2O$ ratio was 2:1, the support was immersed in a bath having a temperature of 82° C. for 45 seconds). The coating solution was coated onto the substrate by means of a wire-wound bar. The solution concentration was selected to provide the specified dry film composition with a coating weight of 1.3 g/m$^2$ after thorough drying and curing at 130° C. (measured on the web), as described in Example 1.

The oleophobic silicone top layer was applied as in example 1 and the member was evaluated as in Example 1.

Comparative Example 8

Comparative Example 7 was repeated, but the imaging layer was coated on a 0.3 mm-thick degreased aluminum sheet without electrochemical graining, or anodizing, or post-anodic treatment.

The following table presents results of the evaluation procedures for Examples 1 through Comparative Example 4:

| Example | MEK Rubs | Imaging Sensitivity (mJ/cm$^2$) |
|---|---|---|
| Example 1 | 15 | 141 |
| Example 2 | 15 | 141 |
| Example 3 | 15 | 141 |
| Comparative Example 4 | 2 | 177 |

-continued

| Example | MEK Rubs | Imaging Sensitivity (mJ/cm$^2$) |
|---|---|---|
| Comparative Example 7 | 15 | 283 |
| Comparative Example 8 | 15 | 283 |

Examples 1 through 3, which utilize a grained and anodized aluminum sheet and a nitrocellulose-based imaging layer, show very good solvent resistance and high sensitivity. The presence or absence of a post-anodic treatment is unimportant for good performance (Example 2). Comparative Example 4 without a grained and anodized aluminum sheet, but which comprises nitrocellulose, has neither suitable solvent resistance nor high sensitivity. Comparative Examples 7 and 8 demonstrate that the presence of a grained and anodized aluminum sheet is only necessary to maintain suitable high solvent resistance when nitrocellulose is present in the imaging layer. Both Comparative Examples contain no nitrocellulose and both lead to high solvent resistance accompanying poor sensitivity, regardless whether grained and anodized aluminum or a simple degreased aluminum sheet is selected.

Although the present invention has been described with reference to specific details, it is not intended that such details should be regarded as limitations upon the scope of the invention, except as and to the extent that they are included in the accompanying claims.

What is claimed is:

1. A method of dry printing comprising the steps of:

providing a lithographic printing member consisting essentially of (i) an oleophobic topmost layer, (ii) disposed thereunder, a dried, crosslinked polymeric imaging layer consisting essentially of (a) a nitrocellulose composition, (b) a melamine binder and (c) dispersed therein, an infrared-absorbing dye or pigment, the melamine binder constituting at least 35% by weight of the polymeric imaging layer, and (iii) disposed under and in direct contact with the polymeric imaging layer, a metal sheet having a grained surface;

exposing the printing member to infrared imaging radiation in an imagewise pattern to cause ablation of the imaging layer;

cleaning the printing member by rubbing with plain tap water to reveal the grained metal surface; and printing with the printing member by repeatedly applying only ink to the printing member, whereby the ink adheres to the grained metal surface where revealed and not to the oleophobic layer, and transferring the ink to a recording medium.

2. The method of claim 1, wherein the metal is aluminum.

3. The method of claim 1, wherein the nitrocellulose composition has a nitration level above 10.7% but less then 12.3%.

4. The method of claim 1, wherein the nitrocellulose composition has a viscosity ranging from 1/16 second to 3 seconds.

5. The method of claim 4, wherein the nitrocellulose composition has a viscosity ranging from 1/8 second to 1 second.

6. The method of claim 4, wherein the nitrocellulose composition has a viscosity ranging from 1/8 second to 1/2 second.

7. The method of claim 1, wherein the aluminum sheet has an Ra roughness of at least 0.20 μm.

* * * * *